US007878782B2

(12) United States Patent
Andersen

(10) Patent No.: US 7,878,782 B2
(45) Date of Patent: Feb. 1, 2011

(54) SCREW COMPRESSOR

(75) Inventor: Lars Skovlund Andersen, Maarslet (DK)

(73) Assignee: Johnson Controls Denmark ApS, Hoejbjerg (DK)

( * ) Notice: Subject to any disclaimer, the term of this patent is extended or adjusted under 35 U.S.C. 154(b) by 380 days.

(21) Appl. No.: 12/096,936

(22) PCT Filed: Dec. 12, 2006

(86) PCT No.: PCT/DK2006/000704

§ 371 (c)(1),
(2), (4) Date: Jun. 11, 2008

(87) PCT Pub. No.: WO2007/068246

PCT Pub. Date: Jun. 21, 2007

(65) Prior Publication Data

US 2008/0304990 A1 Dec. 11, 2008

(30) Foreign Application Priority Data

Dec. 12, 2005 (DK) ..... 2005 01756

(51) Int. Cl.
*F04C 18/16* (2006.01)
*F01C 1/16* (2006.01)

(52) U.S. Cl. ..... 418/201.2; 418/201.1; 417/310

(58) Field of Classification Search ..... 418/201.1, 418/205, 206.4, 16, 31, 201.2; 417/310
See application file for complete search history.

(56) References Cited

U.S. PATENT DOCUMENTS 3,151,806 A * 10/1964 Whitfield ..... 418/201.2
3,904,322 A 9/1975 Axelsson (Continued)

FOREIGN PATENT DOCUMENTS

DE 35 05 919 A1 9/1985

(Continued)

OTHER PUBLICATIONS

International Search Report for International Application No. PCT/DK2006/000704 mailed date Mar. 21, 2007.

*Primary Examiner*—Thomas E Denion
*Assistant Examiner*—Mary A Davis
(74) *Attorney, Agent, or Firm*—Roberts Mlotkowski Safran & Cole, P.C.; David S. Safran

(57) ABSTRACT

The present invention relates to a screw compressor and a method for operating the compressor primarily for gaseous refrigerants, comprising a compressor housing (4) and a male (8) and a female (10) screw rotor arranged in screw rotor bores in the compressor housing (4), which male and female rotor are co-rotatingly drivable and interacting for compressing the refrigerant, which screw compressor comprises at least one slider (22) movable in relation to the male and the female rotor, where movement of the slider controls the internal volume ratio of the screw compressor, which slider is moveable in a slider housing (20) in a direction sideways to the plane formed by the rotational axes of the male and the female rotor, which slider, interacting with the male and the female rotor, comprises at least two surfaces (152, 154) cooperating with subsequent surfaces (156, 158) placed in conjunction with the slider housing for controlling the angular and linear placement of the slider in its forward position.

18 Claims, 8 Drawing Sheets

U.S. PATENT DOCUMENTS

| | | | | |
|---|---|---|---|---|
| 4,281,975 | A | 8/1981 | Blackwell | |
| 4,575,323 | A * | 3/1986 | Yoshimura | 418/201.2 |
| 4,913,634 | A | 4/1990 | Nagata et al. | |
| 5,044,909 | A | 9/1991 | Lindström | |
| 2005/0001302 | A1 | 1/2005 | Tanie et al. | |

FOREIGN PATENT DOCUMENTS

| | | | |
|---|---|---|---|
| FR | 2 439 887 | A1 | 5/1980 |
| JP | 59-119085 | A | 7/1984 |

* cited by examiner 226
246
223
222
230
252
253
229
228
230
231
233
256
259

243
253

223
245
255

242
252
244
254
222
204
245
244
240
242
243
259
258
255
245
244
254
250
248
242
252
243
253
256
241
257

Fig. 19
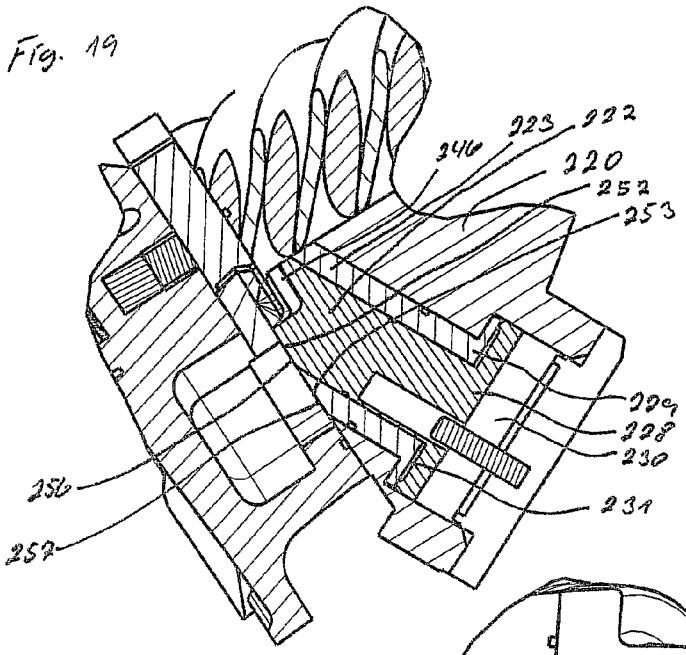
Fig. 20
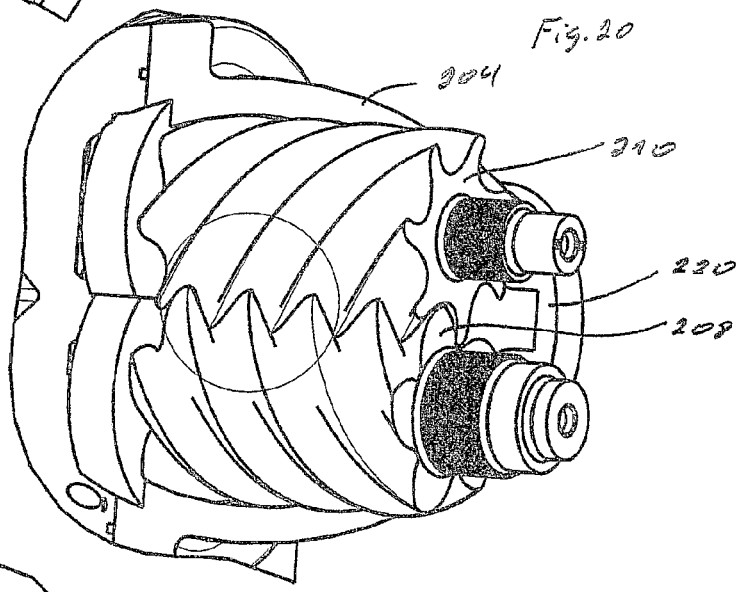
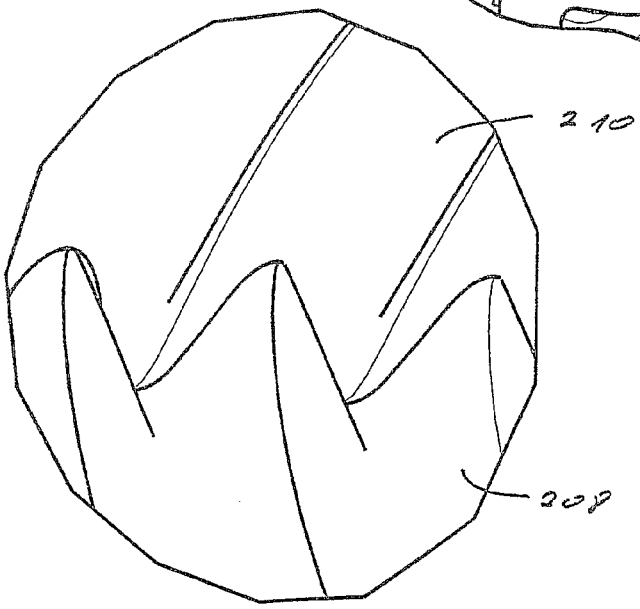
Fig. 21

SCREW COMPRESSOR

FIELD OF THE INVENTION

The present invention relates to a screw compressor primarily for gaseous refrigerants, comprising a compressor housing, which comprises a male and a female screw rotor arranged in screw rotor bores in the compressor housing, which male and female rotor are co-rotatingly drivable and interacting for compressing the refrigerant, which screw compressor comprises at least one slider, which slider is movable in relation to the male and the female rotor, where movement of the slider controls the internal volume ratio of the screw compressor, which slider is moveable in a slider housing, which slider is in a direction sidewards to the plane formed by the rotational axes of the male and the female rotor, which slider is interacting with the male and the female rotor.

The present invention further relates to a method for controlling the discharge of a screw compressor, which compressor comprises a male and a female screw rotor arranged in screw rotor bores in the compressor housing, which male and female rotor are co-rotatingly drivable and interacting for compressing the refrigerant, where a slider is moved in relation to the male and the female rotor from a sidewards direction, which direction deviates several degrees from the longitudinal axes of rotation of the male and the female rotor, which slider is operable for controlling the discharge of the compressor.

BACKGROUND OF THE INVENTION

US2005/001302 describes a screw compressor for gaseous media, in particular refrigerants, comprising a compressor housing, two screw rotors which are arranged in screw rotor bores in the compressor housing, which are rotatingly drivable and interact to compress the medium, and a control slide arranged adjacent the screw rotors and movable in a direction of displacement for controlling the compression of the screw compressor. In order to solve the problem that the compression of the screw compressor can be controlled, but not precisely regulated, it is proposed that a scannable element, which is scannable with a measuring sensor so as to recognize a position of the control slide in the direction of displacement, is coupled with the control slide.

U.S. Pat. No. 4,913,634 describes a screw compressor in which a pair of screw rotors supported by bearings and accommodated in a casing acts to compress a gas and in which a slide valve disposed between an inner wall of the casing and the pair of screw rotors are capable of moving axially while maintaining a small gap between itself and the outer peripheries of the screw rotors, the rate of gas flow bypassed to an inlet port during compression being regulated by axially moving the slide valve. The screw compressor has a side cover in which a bearing for supporting the pair of screw rotors on the discharge side and a slide valve driving hydraulic means are incorporated and which are disposed on the discharge side of the screw rotors; a discharge axial port formed in the side cover; and at least one projection continuous with an opening edge of the discharge axial port and in contact with a semi-circular surface of the slide valve facing in the radial direction thereof, the projection acting to limit the radial movement of the slide valve while the slide valve is moving in contact with the top end of the projection U.S. Pat. No. 4,281,975 describes a screw compressor which includes a contacting a male and female rotor with respect to which a slide valve is operable to control the discharge of the compressor and also regulate the pressure of the fluid pumped or compressed thereby, where the improvement comprises a limited number of different embodiments of anti-friction constructions for supporting the slide valve within the cylindrical bore provided therefore in the housing within which the male and female rotors operate, the wear upon the slide valve within the bore therefore is thereby minimized and the force required to move the slide valve is minimized.

U.S. Pat. No. 5,044,909 concerns a rotary compressor of a cooling or heat pump system, the inner volume relation should be related in a predetermined way to the pressure relation of the compressor for an optimal efficiency to be achieved. The built-in volume relation must therefore be variable to be adapted, for example, to full load and partial load. In order to achieve the highest efficiency with respect to loading requirements, a valve device has been developed, in which the discharge port is formed in such a way as to substantially correspond to the theoretically correct radial discharge port and in which a valve body adapted for the purpose has its line of action oriented towards the outlet plane. The valve body is arranged in such a way that in its fully inserted position in the outlet port the mantle wall will correspond to the mantle wall of the working space of the compressor, and will be adjacent to the rotors at a minimum amount of play by means of the end face having been provided with a pointed line surrounded by two concave surface. The outlet port in the mantle wall of the working space of the rotary compressor is delimited by an outlet plane of the compressor and by the screw lines in the mantle wall, which correspond to the cam surfaces of the rotors, which cam surfaces interact in the direction of the outlet plane of the compressor.

It is of the utmost importance for the valve body to move on a certain plane in order not to get into a wrong position relative to its correct position in relation to the outlet port and the outlet plane; for example, the valve body can be given, for example, a substantially circular-cylindrical cross-section, whereby a good guiding surface for the valve body is achieved.

In order for the valve body not to rotate during its movement up to the outlet port and back again, the valve body can be provided with guiding means, such as grooves. With the valve body in an inclined position relatively to the running rotors, the outlet port can be formed more or less in correspondence with the theoretical outlet port, and at the same time a fully closed sealing line between the rotor housing and the outlet plane is achieved, which also contributes towards making the rotary compressor easier to handle; for example, when the rotors are to be inspected, only the valve body has to be removed. Further, the inclined position implies forming the valve body with an oblique surface, which will move towards the outlet plane, whereby the valve body will be guided in its movement towards the outlet port and will finally be fixed in its fully inserted position.

OBJECT OF THE INVENTION

It is the object of the invention to develop a highly effective screw compressor, which screw compressor can regulate the discharge pressure.

DESCRIPTION OF THE INVENTION

This can be achieved by a screw compressor as described in the opening paragraph if the compressor comprises discharge end plates, which discharge endplates can be place between the discharge end of the male and female screw rotors and the end plate of the compressor housing, which discharge end plates comprises a discharge opening, which discharge end plates comprise discharge end walls, where the slider comprises at least two areas, which areas are cooperating with subsequent areas placed in conjunction with the discharge end walls for controlling the angular and linear placement of the slider for avoiding rotor contacts.

It can hereby be achieved that independent pressure volumes formed between the male and the female rotor during the interaction of the rotors are connected to the discharge before the last compression takes place, when this slider is moved away from its forward position. This will lead to a reduction of the discharge pressure of the compressor. This shunting of the discharge from the rotors will automatically also increase the volume of compressed gas that leaves the compressor. The sideways placement of the slider and the slider housing lead to the rotor bores in the compressor housing being formed in the housing without any cut-outs along most of the length of the rotor bores before the sideways opening for the slider housing. This can lead to a very tight screw compressor without any leaks along for example a slider operating parallel to the male and the female rotor. The screw compressor with the sideways acting slider is much cheaper to produce than the traditional screw compressors with sliding elements. It is easy to produce the two bores for the male and the female rotor and afterwards to form the sideways slider housing.

The angle of the slider and the slider housing is preferably more than 45 degrees in relation to the longitudinal rotational axes of the male and the female rotor. This can lead to an effective placement of the slider if the angle of operation is higher than 45 degrees.

The angle of the slider and the slider housing can be more than 60 degrees in relation to the longitudinal rotational axes of the male and the female rotor. It can hereby be achieved that the angle for the slider and the slider housing could be up to 90 degrees so that the slider is acting towards the male and the female rotor directly perpendicular. In certain embodiments of the invention, the angle could be the supplementary angle to the above-mentioned one.

The slider can be movable in the housing, which housing comprises at least one pressure chamber, which pressure chamber is connected to the discharge volume of the compressor, where the slider has a front surface, at which surface the pressure is forcing the slider to move backwards from the male and the female rotor. It is hereby achieved that the actual discharge pressure of the screw compressor will force the slider backwards. Means for forcing the slider in the opposite direction are can be achieved by different force acting methods and components. A primitive solution could be that the slider is operating against the pressure of a spring. This could lead to an automatic pressure adjustment of the screw compressor. Other actuating means would also be possible. An example is that a hydraulic pressure is actuating the slider into a direction towards the male and the female screw. A combination of a spring and hydraulic or gas activation would probably also be possible for pressing the slider towards the rotors.

The housing can comprise at least a second pressure chamber, which second pressure chamber contains a back surface of the slider for forcing the slider to move forwards towards the male and the female rotor. It is hereby achieved that a pressure chamber is placed behind the slider, and this pressure chamber can be activated for example by refrigerant. In this way, the compressor can operate without use of an extra media for activation.

The front of the slider can be placed in the first pressure chamber, which front of the slider has an active pressure surface, which pressure surface is smaller than the active pressure surface of the back surface of the slider placed in the second pressure chamber. It is hereby achieved that the backside pressure can be controlled so that this pressure can achieve nearly all pressure values between the suction pressure of the compressor and the discharge pressure of the compressor. In this way, the slider can be activated with a pressure that can be regulated to every value between these two outer limits. This can lead to a possible solution where the slider is placed in different positions between two outer positions.

The second pressure chamber can be connected through an orifice towards the suction side of the compressor, which second chamber further is connected through a first electromagnetic valve to the discharge pressure of the compressor. This will lead to a constant pressure reduction in the second chamber to achieve an inlet pressure in that chamber if the electromagnetic valve is closed.

The first electromagnetic valve can be connected to an electronic circuit comprising computer means. It can hereby be achieved that an increase of the pressure in the second chamber can be achieved by periodical opening of the electromagnetic valve. Depending on the size of the previously described orifice and the opening of the electromagnetic valve, the pressure in the second chamber can achieve a value that maximally is very close to the discharge pressure of the compressor. This pressure will then always move the slider forwards.

It is hereby possible that the computer takes over the control of the discharge pressure for the compressor. These computer means can also comprise further means for controlling a motor, which drives the compressor. If the motor is an electromotor, a kind of semiconductor switches will probably be used.

The slider can cooperate with at least one mechanical stop when the slider is placed in a forward position for increasing the discharge pressure of the compressor. This assures that the slider will not come in touch with the rotors in the compressor. By using this stop, a very effective and very close position towards the rotors can be achieved.

The invention further comprises a method for controlling the slider, where a discharge opening is formed in discharge endplates, where the discharge endplates comprises discharge end walls, where the slider comprises guiding areas which areas interacts with corresponding areas placed in conjunction with the discharge end wall for controlling the angular and linear placement of the slider when the slider is operating adjacent to the rotors at a minimum amount of play towards the male and the female screw rotor.

In this way, the interaction between the slider and the male and the female rotor can be made only in a limited area near the pressure end of the male and the female rotor. In fact, the slider can when it is away from interaction make a shortcut between the two last compression volumes formed between the male and the female rotor. This shortcut will lead to an increasing volume and a decreasing pressure at the pressure discharge. The sideways interaction reduces the number of possible leaks that typically occur if a slider operates along the male and the female screw rotor. This parallel slider will end up in a very difficult construction of the compressor. Furthermore, there will be very small openings towards the slider, and these openings can be a kind of shortcuts that is decreasing the effectiveness of the compressor.

The slider can move from a first position to a second position in a slider housing, which slider housing can be placed at an angle of more than 45 degrees in relation to the longitudinal rotational axes of the male and the female rotor.

This relatively high angle is effective because the slider housing has limited influence on the construction of the rest of the compressor housing.

The angle of the slider and the slider housing can be more than 60 degrees in relation to the longitudinal rotational axes of the male and the female rotor. A still steeper angler for the slider seems more and more effective. The limitation for this patent application is as such not 90 degrees, even slider angles over 90 degrees would be possible in a certain embodiment, depending on which end of the compressor that is connected to a driving motor.

The slider can be movable by the discharge pressure, which discharge pressure acts on the effective area of the front surface of the slider to force the slider to move backwards from the male and the female rotor. By letting the slider be movable backwards of the discharge pressure of the compressor, an automatic pressure control can easily be achieved. As soon as the slider is moved backwards, the output pressure is reduced, and then the pressure of the front end of the slider is reduced. Depending on which activation means that are placed in conjunction with the slider, it could be moved forward, for example by a spring, or it could be moved forward by other activation means which could be hydraulic or also mechanical or electromagnetic means would be possible. Even a kind of analogue pressure regulation could be formed in this way because it would be possible to let the slider take a position where a certain pressure occurs, where there is a limited effect on the slider and where a backwards movement of the slider will reduce the effect of the slider.

The backside of the slider can be under influence of a pressure, which pressure can be regulated to force the slider to move forwards towards the male and the female rotor. It is hereby achieved that a pressure on the backside will move the slider forwards. This pressure can be hydraulic where for example high pressure oil from the compressor could be used, or it is possible to use the high pressure refrigerant delivered from the discharge of the compressor as the medium.

The front side of the slider has an active pressure surface, which pressure surface is smaller than the active pressure surface of the back surface of the slider. It is hereby achieved that a smaller pressure of the backside in relation to the pressure of the front side can keep the slider in a kind of balance. Increasing pressure on the backside will move the slider forwards, and decreasing pressure will move the slider backwards.

The pressure in the second pressure camber can be decreased by an orifice connected towards the suction side of the compressor, which pressure in the second chamber further is controlled by a first electromagnetic valve connected to the discharge pressure of the compressor. By using an orifice to decrease the pressure and a magnetic valve to increase the pressure, it will be possible to adjust the pressure in the chamber between the suction pressure of the compressor and the discharge pressure of the compressor. The orifice can have an opening that is relatively small in relation to the opening degree of the magnetic valve. This will lead to an increasing pressure as soon as the magnetic valve is opened, but in the other way, as soon as the magnetic valve is closed, the pressure will start decreasing in the chamber. Depending again on the size of the orifice, this pressure decrease can be relatively slow which will let the slider move relatively slowly. This can automatically lead to a dampening of oscillations of the slider.

An electronic circuit comprising computer means can control the first electromagnetic valve. Computer means can hereby control the opening degree of the magnetic valve. It would be possible that the computer means controls the valve in a way of modulation so that different positions of the slider could be obtained.

The slider can be controlled by one mechanical stop, when the slider is placed in a position for increasing the discharge pressure of the compressor. The mechanical stop is necessary if the slider shall be operating very closely to the rotating male and female rotor. Only by using a stop, it will be possible to come that close to the rotating elements, which are necessary for making an effective compression. The distance between the slider and the rotating rotors should be limited to the size of an oil film.

DESCRIPTION OF THE DRAWING

FIG. 12 shows a compressor housing and a slider housing.

FIG. 19 shows the same embodiment as the one shown in FIG. 11, were the rotors are shown above the sliders.

FIG. 20 shows the same embodiment as the one shown in FIG. 12, where the rotors 0 are shown FIG. 21 is an enlarged view of FIG. 20

DETAILED DESCRIPTION OF THE INVENTION

Figure 1:
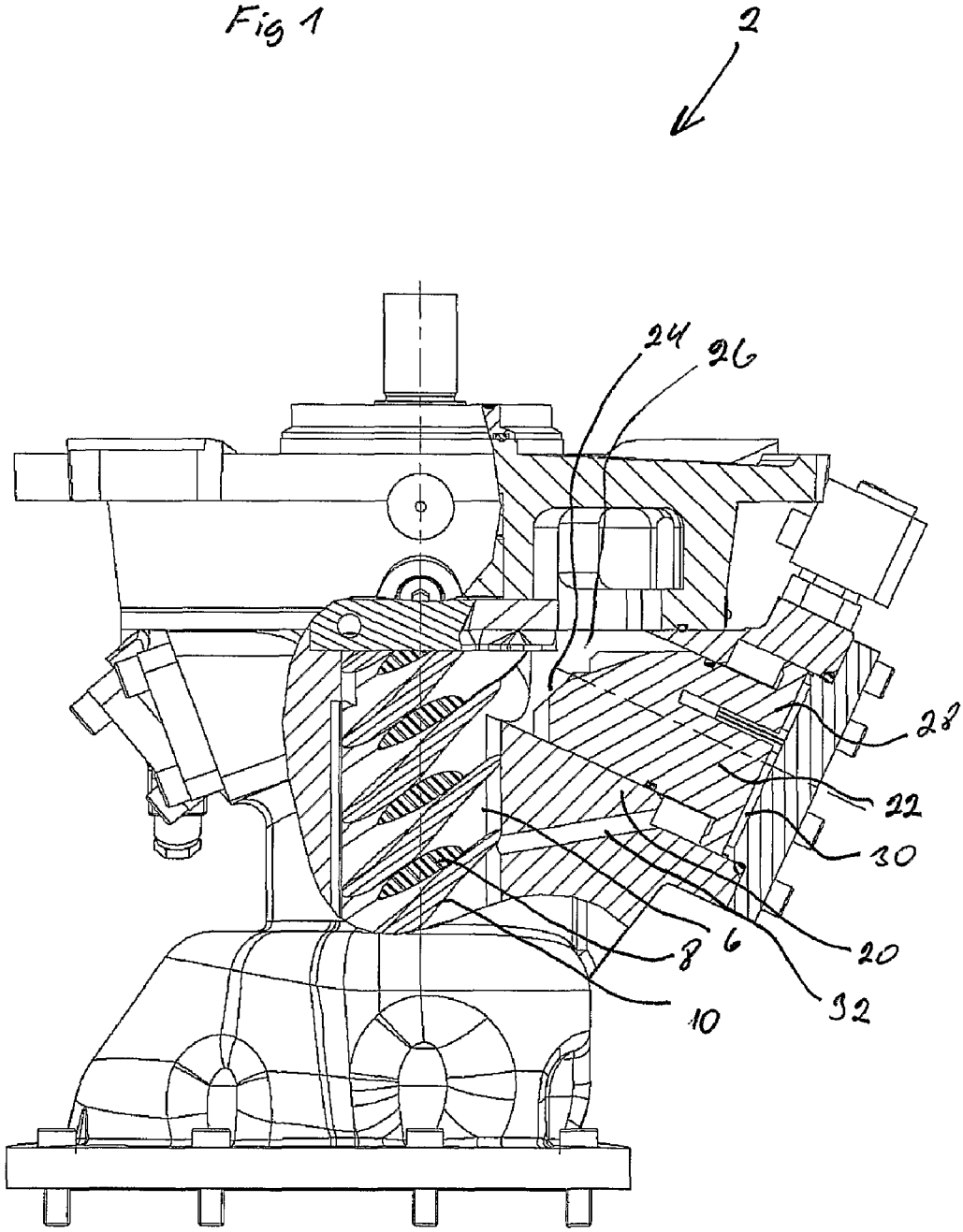
FIG. 1 shows a sectional view of a part of a screw compressor

FIG. 1 shows a sectional view of a screw compressor 2 comprising a housing 4, which comprises a bore 6, which contains the male 8 and the female 10 rotors. A slider housing 20 comprises a slider 22 which slider 22 has a front area 24 placed in a pressure chamber 26. Furthermore, the slider 22 comprises a backside 28 placed in a second pressure chamber 30. FIG. 1 shows moreover a channel 32 connected to the suction side of the compressor.

In operation, the slider 22 can be moved away from interaction with the male 8 and the female 10 rotors in the rotor housing 6. The slider 22 is shown in its forward position where the slider front has a form that is equal to the form of the housing 6, but on the front surface of the slider 22, the pressure volume 26 is acting. The discharge pressure of the compressor will here try to force the slider 22 to perform a backwards movement in the slider bore 20. This backwards movement will reduce the second volume 30, which can be connected through a not shown orifice. This will automatically lead to a dampening of the movement of the slider 22. By changing the pressure in the second chamber 30, the back surface 28 of the slider can come under pressure, which will press the slider 22 back to its position where it is in touch with a stop.

Figure 2:
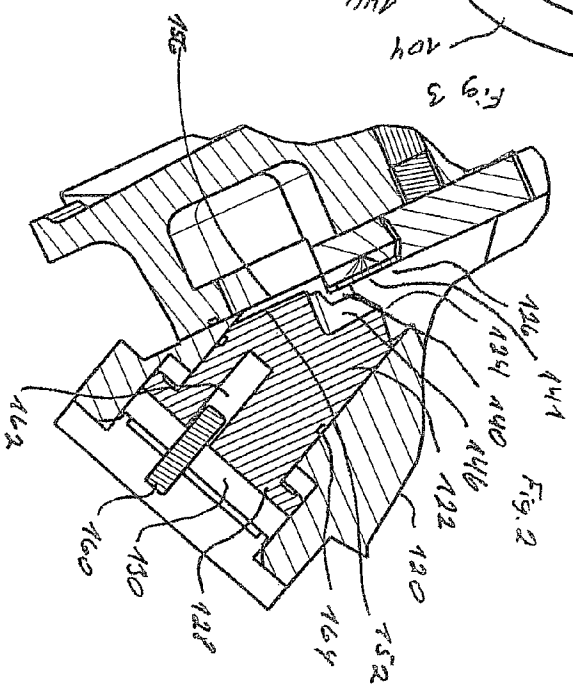
FIG. 2 shows a enlarged sectional view of the part of a screw compressor shown at FIG. 1.

FIG. 2 shows a sectional view of the part of a screw compressor, which comprises the previously described slider. In FIG. 2, a slider 122 is shown which slider 122 has a front surface 124 placed in conjunction with a pressure chamber 126. The backside 128 of the slider 122 is placed in a second pressure chamber 130. The discharge pressure port 140 is placed in a discharge endplate 141, where the discharge port 140 cooperates with a cut-out 146 in the front of the slider 122. The slider 122 has a surface 152, which cooperates with a surface 156 placed in conjunction with the discharge port 140 of the screw compressor. A guiding-in 160 cooperates with a groove 162 which groove 162 is formed in the backside 128 of the slider 122.

In FIG. 2, the slider 122 is pressed backwards away from the discharge port 140 by the discharge pressure. It is hereby achieved that the discharge port 140 is increased in size along the discharge end of the male and female rotors so that the pressure chambers in the end of the volumes between the two rotors are connected to the outlet. This leads to a reduced pressure and a higher flow of gas.

Figure 3:
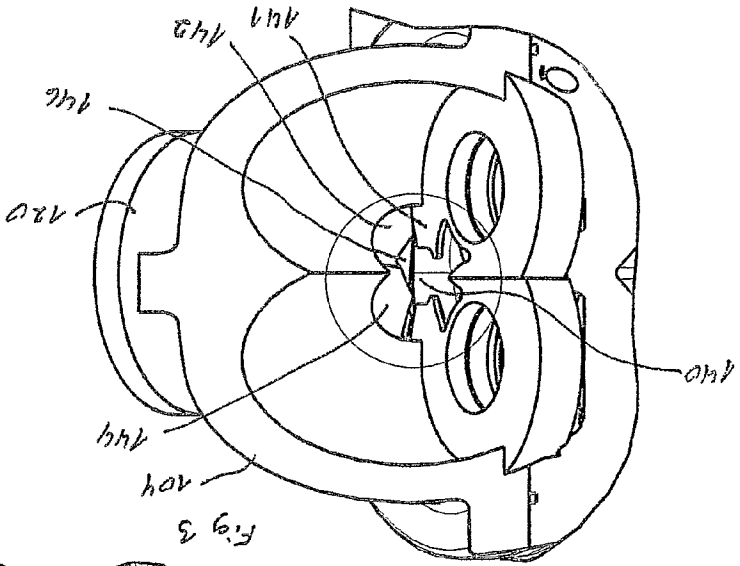
FIG. 3 shows a sectional view of the same elements as seen in FIG. 2

FIG. 3 shows a sectional view of the same elements as seen in FIG. 2 but seen from the upper side of FIG. 2. FIG. 3 shows a compressor housing 104 and a slider housing 120. Inside, the discharge port 140 is placed in the discharge endplate 141. Furthermore, the surfaces 142, 144 of front end of the slider 122. Between the two surfaces 142,144, the cut-out 146 is shown.

Figure 4:
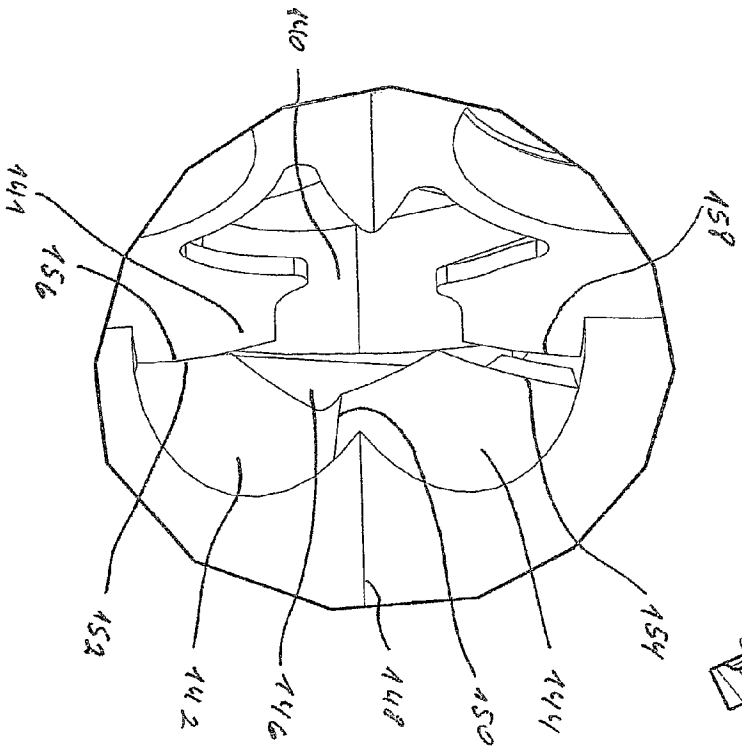
FIG. 4 shows an enlarged view of FIG. 3.

FIG. 4 shows an enlarged view of FIG. 3. The discharge port 140 in the discharge endplate 141 is shown, and the front end of the slider 122 is shown with its surface 142,144. The number 148 indicates the centre line of the compressor housing, and the number 150 indicates the centre line of the slider 122. The slider 122 has a surface 152 and a further surface 154. The end surface 152 cooperates with a surface 156 placed in conjunction with the discharge opening in the compressor. Further, the end surface 154 will cooperate with a surface 158 also in conjunction with the pressure outlet.

As already mentioned for FIG. 2, it is also indicated in FIGS. 3 and 4 that the slider 122 is placed in its backwards position. In this position, in FIG. 4 a difference between the centre line 150 of the slider and the centre line 148 of the housing is shown. This indicates that the slider is rotated out of its optimal position when it is placed in its backwards position. This leads to a large opening between the surface 154 and the surface 158.

Figure 5:
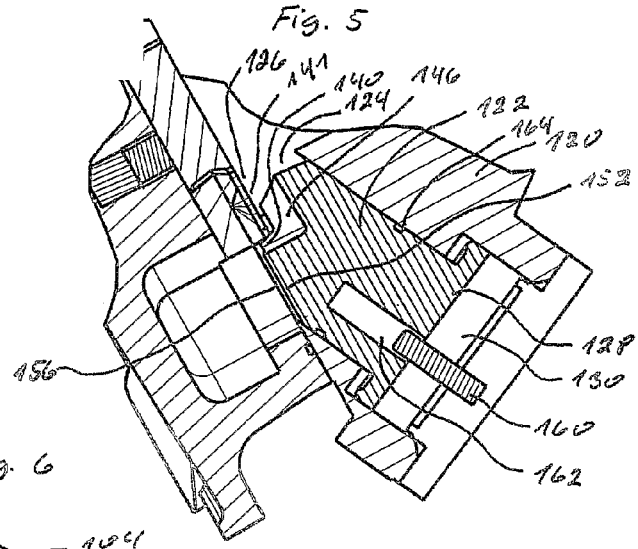
FIGS. 5, 6 and 7 show the same components in different situations.
Figure 6:
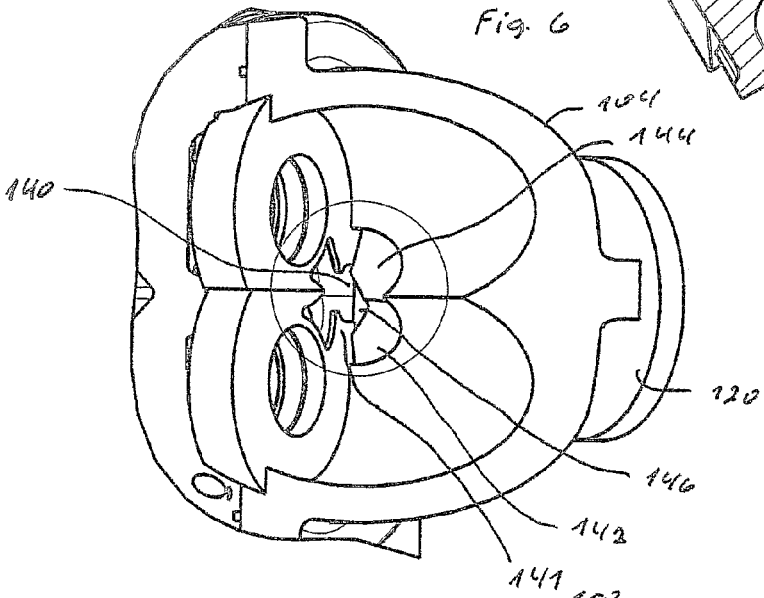
Figure 7:
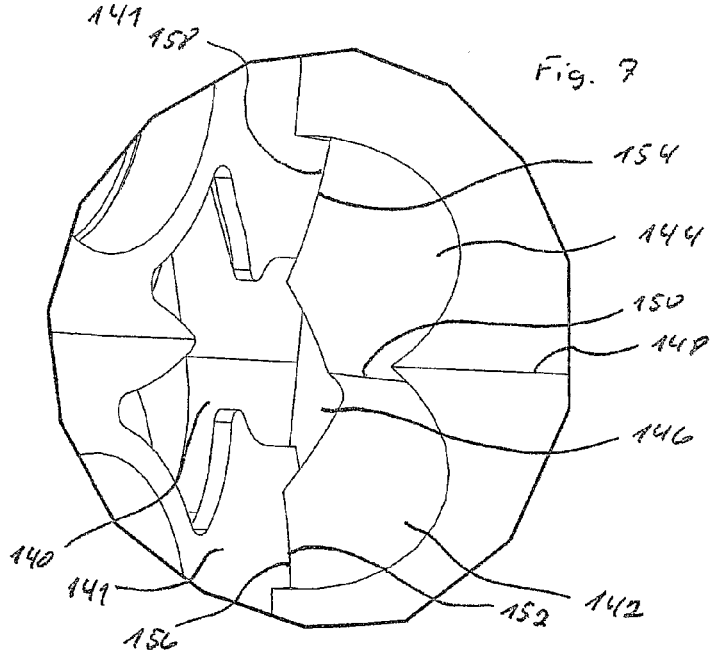

FIGS. 5, 6 and 7 shows exactly the same components as already mentioned for FIGS. 2, 3 and 4. The difference between the figures is that the slider 122 is now placed in a position between its two end situations. This can be seen in FIG. 5 where the front of the slider 124 is closer to the housing of the rotors. But especially in FIG. 7, the function taking place when the slider is moved downwards is indicated. The slider 122 has been moved forwards so its surface 152 and its surface 154 are rather close to get in touch with the corresponding surface 156 and the surface 158 at the corresponding surfaces at the compressor outlet components. Also, the line 150 in relation to the line 148 is now partly aligned. The open area formed by the cut-out 146 in the slider is now reduced because the opening along the front 124 of the slider is smaller.

Figure 8:
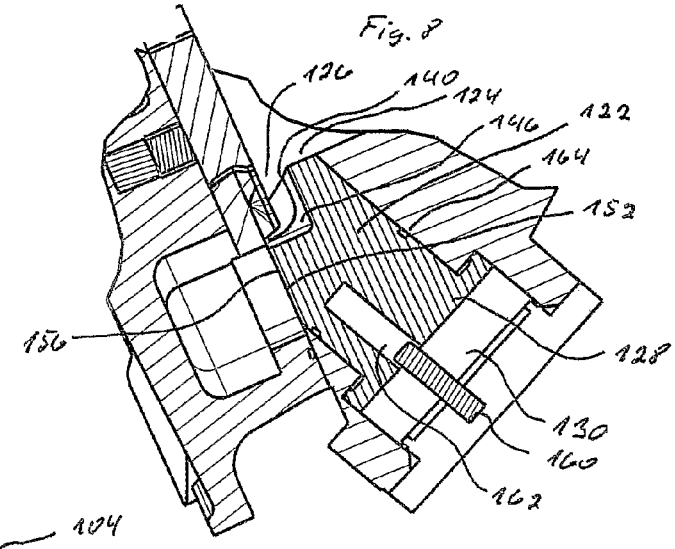
FIGS. 8, 9 and 10 show the slider in its forward position
Figure 9:
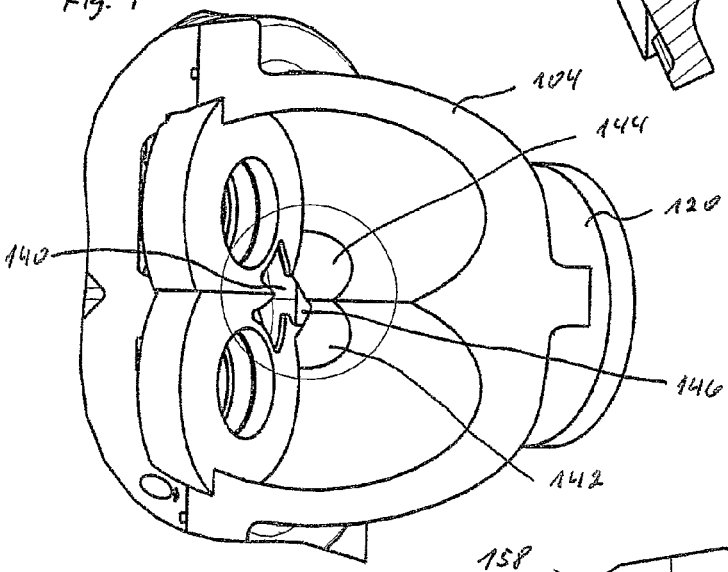
Figure 10:
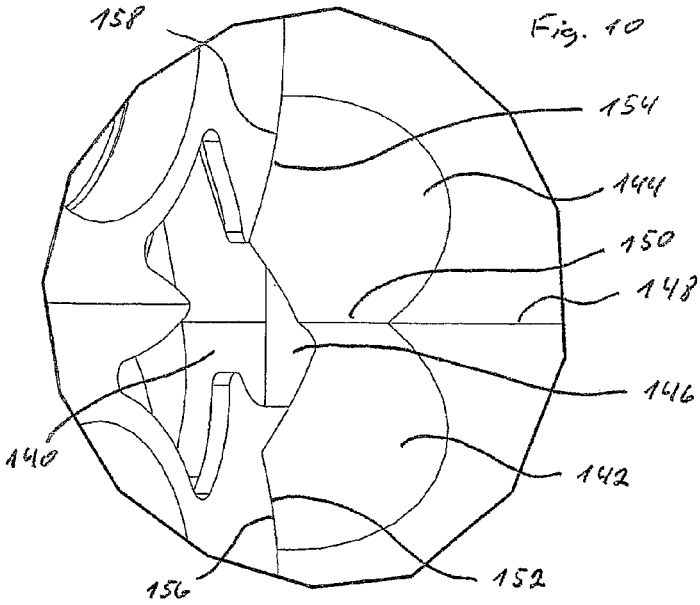

FIGS. 8, 9 and 10 show the slider 122 in its forward position. The front end 124 of the slider 122 is now parallel with the inner wall of the rotor housing. The surface 152 of the slider 122 is now in touch with the surface 156. This is further indicated in FIG. 10 where the surface 152 and the surface 156 are now in touch, and the surface 154 and the surface 156 are also touching each other. It is indicated that the centre line 148 of the compressor housing and the centre line 150 of the slider are now totally aligned. It is also indicated that the opening 146 is now reduced.

By using the direct touch of the slider with the discharge pressure components having the surfaces 156 and 158, this will lead to a nearly perfect alignment of the slider 122 when it is in its front position. This is absolutely necessary; otherwise the slider 122 could get in mechanical touch with the rotating screws.

Figure 11:
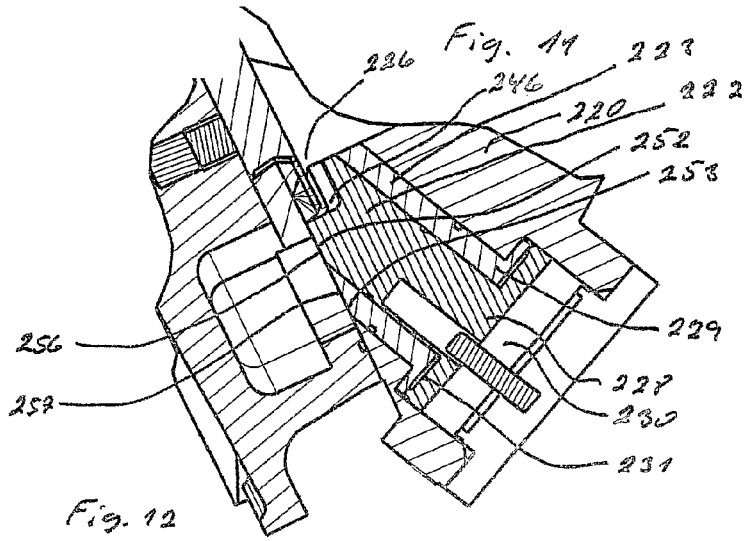
FIGS. 11, 12 and 13 show an alternative embodiment
Figure 12:
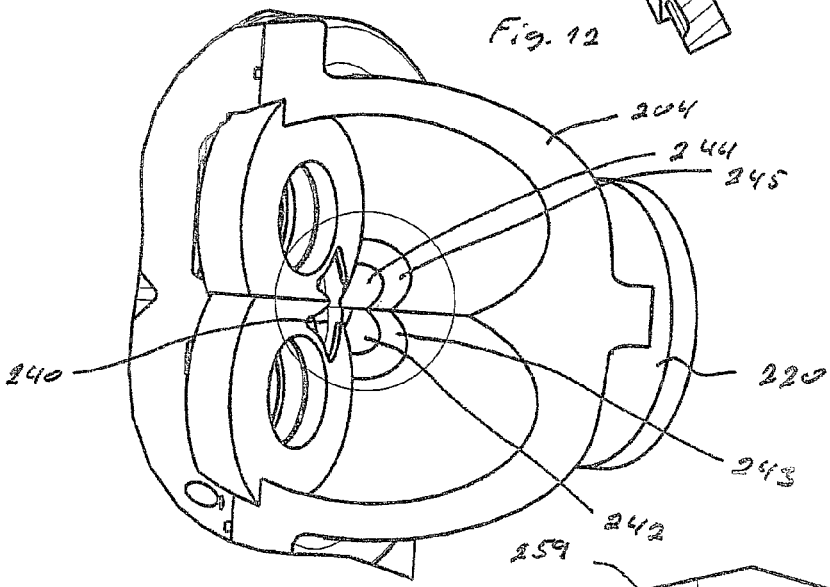
Figure 13:
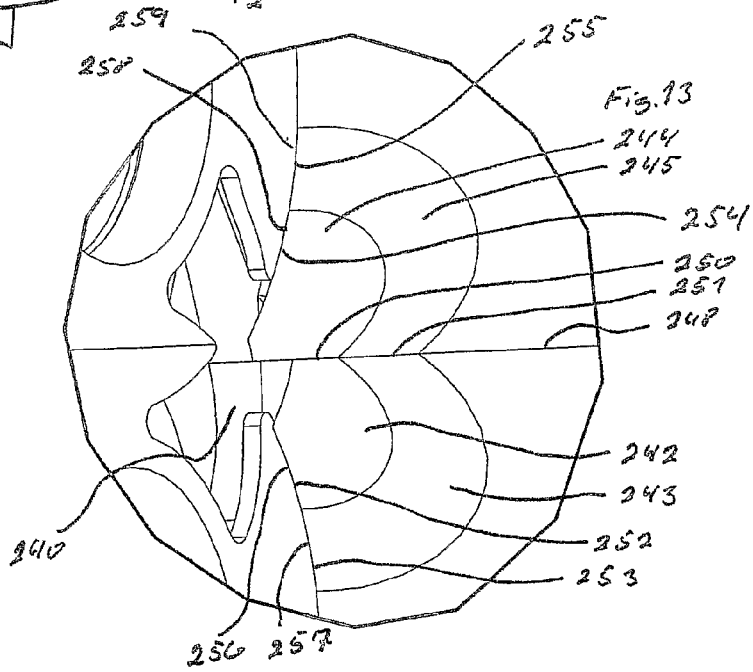

FIGS. 11, 12 and 13 show an alternative embodiment where a slider housing 220 contains an inner slider 222 and an outer slider 223. The inner slider has a back end 228, which cooperates with a pressure chamber 230. The outer slider 223 has an end 229, which cooperates with a pressure chamber 231. The slider 222 has a surface 252 which cooperates with a surface 256 formed at the pressure outlet. The outer slider 223 has a surface 253, which cooperates with a surface 257 at the pressure outlet of the compressor.

In FIG. 12, a compressor housing 204 and a slider housing 220 are seen. The slider 222 has a front surface 242,244, and the slider 223 has surfaces 243,245. In FIG. 13, an enlarged view of the central part of FIG. 12 is shown. FIG. 13 shows a pressure outlet opening 240 placed in the discharge endplate 241. The slider 222 has end surfaces 242,244. The slider 223 has surfaces 243,245. The surface 252 cooperates with a surface 256 at the discharge endplate 241, where the surface 253 cooperates with a surface 257. Further, the surface 254 cooperates with a surface 258. Also the surface 255 cooperates with a surface 259. A centre line of the housing 248, a centre line 250 of the slider 222 and the centre line 251 of the slider 223 are shown.

In operation, it is possible to force the slider 222 backwards by reducing pressure in the chamber 230. This will reduce the discharge pressure of the compressor. Further reduction of the discharge pressure can be achieved by also forcing the slider 223 backwards. This can be achieved if the slider 222 is moved, and the pressure in the chamber 231 is reduced. The two sliders 222, 223 can be moved back in their front position by first increasing the pressure in the chamber 231 and afterwards increasing the pressure in the chamber 230. Hereby, it is achieved that a compressor can be adjusted in at least three different steps. It will probably be possible to also achieve analogue discharge control of the compressor by placing one of the sliders or maybe both sliders in a position between the minimum or maximum positions.

Figures 14, 15, 16, 17, 18:
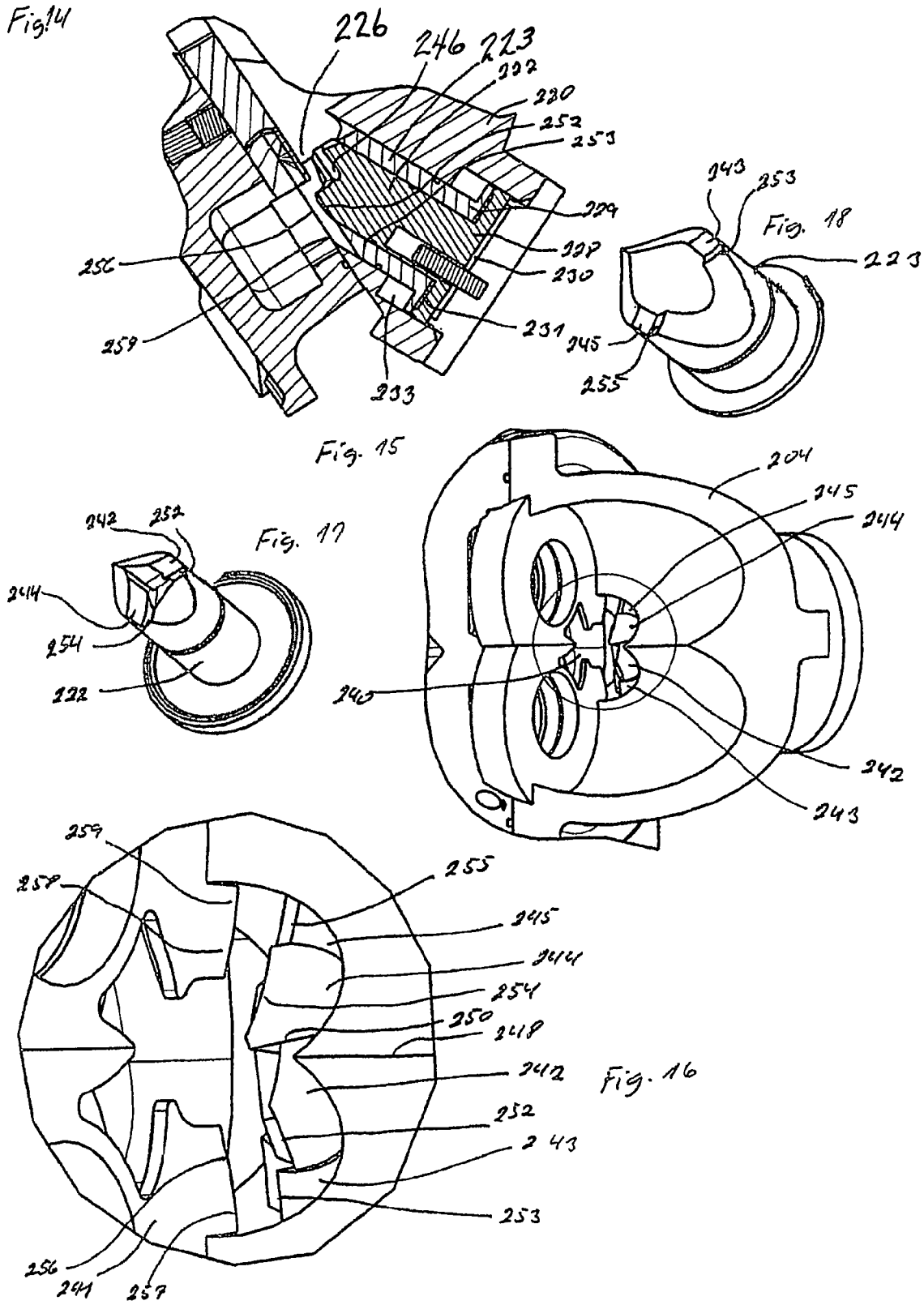
FIGS. 14, 15, and 16 show the same embodiment as the one shown in FIGS. 11, 12, and 13.
FIG. 17 shows an inner slider
FIG. 18 shows an outer slider

FIGS. 14, 15, and 16 show the same embodiment as the one shown in FIGS. 11, 12, and 13. Components already mentioned above will not be mentioned again in the following.

The difference between the embodiment shown in FIGS. 11, 12, 13 and the embodiment shown in FIGS. 14, 15, 16 is that the sliders 222 and 223 in the latter are shown in their backward position. A working chamber 233 is now visible under the backside 229 of the slider 233. Further, the chamber 231 is visible between the backside 229 of the outer slider and the backside 228 of the inner slider. From FIG. 16 it appears that the outer slider has a front edge 255 which can engage with the edge 259 at the discharge end plate 241. The inner slider also has a front edge 254 which can engage with the edge 258 positioned on the edge of the discharge end plate 241. Furthermore the edge 252 at the inner slider is shown which will cooperate with the edge 256 at the edge of the discharge end plate 241. Further, the outer slider has a front edge 253 which will cooperate with the edge 257 at the discharge end plate 241. Further in FIG. 16, the centre line 248 for the compressor house 204 and the centre line 250 of the inner slider can be seen. It is clearly indicated that the inner slider is misaligned in the angular and sideward position in relation to the centre line 248.

In operation this misalignment is harmless in the backward position shown. However, when the sliders 222,223 is moved into contact with the discharge end plate 241, both sliders 222,223 will be aligned.

FIG. 17 shows an inner slider 222 which has contact areas 242 and 244 for being aligned when they engages with the discharge end plate 241. Furthermore edges 252, 254 are shown which are positioned in such a way that they will engage the edge of the discharge end plate 241.

FIG. 18 shows an outer slider 223 which comprises contact areas 243 and 245 for engaging with the discharge end plate 241 when it is in its forward position of the slider. Further contact areas 253 and 255 are shown. These contact areas will engage the edge of the discharge end plate 241.

FIG. 19 shows the same embodiment as the one shown in FIG. 11, the difference being that the rotors are shown above the sliders.

FIG. 20 shows the same embodiment as the one shown in FIG. 12, the difference being that the rotors 208 and 210 are shown.

FIG. 21 is an enlarged view of FIG. 20 and also shows the two rotors 208 and 210.

Figure 22:
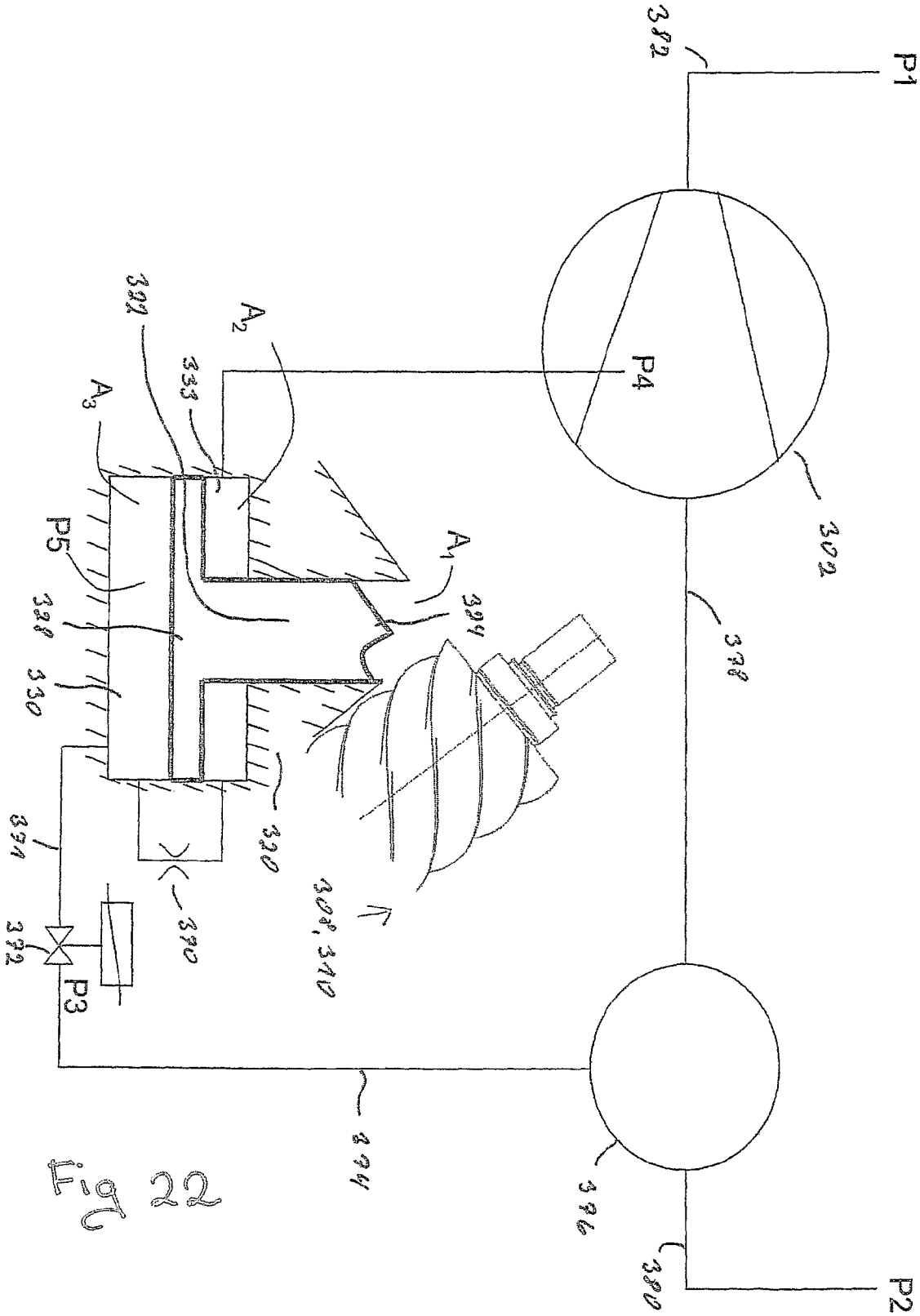
FIG. 22 shows a compressor which has a suction pipe connected to the suction side of the compressor.

FIG. 22 shows a compressor 302 which has a suction pipe 382 connected to the suction side of the compressor. The compressor 302 has a discharge pipe 378 which is connected to an oil management system 376 from which refrigerant is flowing to a pipe 380. In the compressor 302 one of the rotors 308 and 310 can be seen. A slider 322 can also be seen. This slider has a front area 324 which engage the rotors 308 and 310. The slider has a backside 328, which is placed in a working chamber 380. The working chamber 330 is connected to the chamber 333 through a flow-restriction 370. From chamber 333 there is a connection towards the compressor to a point in the compressor having a relatively low pressure P4. The chamber 330 is further connected to a line 371 to a magnetic valve 372 and further to a line 374 to the oil management system 376.

In operation, the discharge pressure P2 will be present at the area A1, which is the front of the slider 322. This pressure P2 working on A1 will press the slider backwards. In the chamber 333 a pressure P4 is operating which is slightly above P1, which is the suction pressure of the compressor. The flow-restriction unit 370 also connects the pressure P4 to the chamber 330 so that oil can flow from this chamber through the flow-restriction unit 370 towards the chamber 333 and from here towards the compressor at the pressure P4.

If the valve 372 is open, oil will flow through the line 374 through the valve 372 and further through the line 371 towards the chamber 330. The high-pressure oil also flows through the flow-restriction 370, but in an amount so that the pressure in the chamber 330 will increase. This increasing pressure P5 will now, due to its increase, move the slider 332 forwards. This will bring the slider into its operational forward position where the slider is engaging the rotors and the discharge area at the end of the rotors is reduced. By using oil for hydraulic activation and de-activation of the slider it is achieved that a medium usually applied in the compressor can also be used for this hydraulic activation. By using the oil there will be no leakages for refrigerant and as such no reduction in the amounts of refrigerant, which can be supplied over line 380 to a refrigeration system.

The invention claimed is:

1. A screw compressor primarily for gaseous refrigerants, comprising a compressor housing, which comprises a male and a female screw rotor arranged in screw rotor bores in the compressor housing, which the male and the female screw rotor are co-rotatingly drivable and interacting for compressing the refrigerant, which the screw compressor comprises at least one slider, which the slider is movable in relation to the male and the female screw rotor, where movement of the slider controls the internal volume ratio of the screw compressor, which the slider is moveable in a slider housing, which the slider is operating in a direction sidewards to the plane formed by the rotational axes of the male and the female screw rotor, which the slider is operating adjacent to the screw rotors at a minimum amount of play towards the male and the female screw rotor, wherein the screw compressor comprises discharge end plates, which the discharge endplates are place between the discharge end of the male and female screw rotors and a compressor housing end plate, which the discharge end plates comprises a discharge opening, which the discharge end plates comprise discharge end walls, where the slider comprises at least two areas, which the at least two areas are cooperating with subsequent areas placed in conjunction with the discharge end walls for controlling the angular and linear placement of the slider for avoiding contact with the male and female screw rotors.

2. A screw compressor according to claim 1, wherein the angle of the slider and the slider movement is more than 45 degrees in relation to the plane formed by the rotational axes of the male and the female rotor.

3. A screw compressor according to claim 1, wherein the angle of the slider and the slider movement is more than 60 degrees in relation to the plane formed by the rotational axes of the male and the female rotor.

4. A screw compressor according to claim 3, wherein the slider is movable in the slider housing, which the slider housing comprises at least one pressure chamber, which the at least one pressure chamber is connected to the discharge volume of the screw compressor, where the slider has a front surface, at which the front surface the pressure is forcing the slider to move backwards from the male and the female screw rotor.

5. A screw compressor according to claim 4, wherein the slider housing comprises at least a second pressure chamber, which the second pressure chamber contains the back surface of the slider, for forcing the slider to move forwards towards the male and the female screw rotor.

6. A screw compressor according to claim 5, wherein the front of the slider is placed in the first pressure chamber, which the front of the slider has an active pressure surface, which the active pressure surface is smaller than the active pressure surface of the back surface of the slider placed in the second pressure chamber.

7. A screw compressor according to claim 6, wherein the second pressure chamber is connected through an orifice towards a lower pressure level in the compression chamber, which the second pressure chamber further is connected through a first electromagnetic valve to the discharge pressure of the screw compressor.

8. A screw compressor according to claim 7, wherein the first electromagnetic valve is connected to an electronic circuit comprising computer means.

9. A screw compressor according to claim 8, wherein the slider cooperates with at least one mechanical stop, when the slider is placed in a position for increasing the discharge pressure of the compressor.

10. Method for controlling the discharge of a screw compressor, which the screw compressor comprises a male and a female screw rotor arranged in screw rotor bores in a compressor housing, which the male and the female screw rotor are co-rotatingly drivable and interacting for compressing refrigerant, where a slider is moved in relation to the male and the female screw rotor from a sideways direction, which the sideways direction deviates several degrees from the axes of rotation of the male and the female screw rotor, which the slider is operable for controlling the discharge of the screw compressor, wherein a discharge opening is formed in discharge endplates, where the discharge endplates comprises discharge end walls, where the slider comprises guiding areas which the guiding areas interacts with corresponding areas placed in conjunction with the discharge end wall for controlling the angular and linear placement of the slider when the slider is operating adjacent to the male and the female screw rotors at a minimum amount of play towards the male and the female screw rotor.

11. Method for controlling the discharge of a screw compressor according to claim 10, wherein the slider is moving from a first position to a second position in a slider housing which the slider housing is placed in a angle of more than 45 degrees in relation to the longitudinal rotational axes of the male and the female screw rotor.

12. Method for controlling the discharge of a screw compressor according to claim 11, wherein the angle of the slider and the slider housing is more than 60 degrees in relation to the longitudinal rotational axes of the male and the female screw rotor.

13. Method for controlling the discharge of a screw compressor according to claim 12, wherein the slider is movable by the discharge pressure, which the discharge pressure acts on the effective area of the front surface of the slider for forcing the slider to move backwards from the male and the female screw rotor.

14. Method for controlling the discharge of a screw compressor according to claim 13, wherein the back side of the slider is under influence of a pressure, which the pressure is regulated to force the slider to move forwards towards the male and the female screw rotor.

15. Method for controlling the discharge of a screw compressor according to claim 14, wherein the front of the slider has an active pressure surface, which the active pressure surface is smaller than the active pressure surface of the back surface of the slider.

16. Method for controlling the discharge of a screw compressor according to claim 15, wherein the pressure in the second pressure chamber is decreased by an orifice connected towards a suction side of the compressor, which the pressure in the second pressure chamber further is controlled by a first electromagnetic valve connected to the discharge pressure of the screw compressor.

17. Method for controlling the discharge of a screw compressor according to claim 16, wherein an electronic circuit comprising computer means controls the first electromagnetic valve.

18. Method for controlling the discharge of a screw compressor according to claim 10, wherein the slider is controlled by one mechanical stop, when the slider is placed in a position for increasing the discharge pressure of the screw compressor.

* * * * *